US010107571B2

(12) United States Patent
Augenstein et al.

(10) Patent No.: US 10,107,571 B2
(45) Date of Patent: Oct. 23, 2018

(54) HEAT EXCHANGER HAVING A HEAT TRANSFER BLOCK WITH A SCREEN ARRANGED THEREON

(71) Applicant: MAHLE International GmbH, Stuttgart (DE)

(72) Inventors: Claus Augenstein, Gerlingen (DE); Christian Oberlechner, Ludwigsburg (DE); Markus Reck, Stuttgart (DE); Wolfgang Reeb, Aichtal (DE); Stefan Weise, Esslingen am Neckar (DE)

(73) Assignee: MAHLE International GmbH, Stuttgart (DE)

( * ) Notice: Subject to any disclaimer, the term of this patent is extended or adjusted under 35 U.S.C. 154(b) by 342 days.

(21) Appl. No.: 14/852,929

(22) Filed: Sep. 14, 2015

(65) Prior Publication Data

US 2016/0076826 A1 Mar. 17, 2016

(30) Foreign Application Priority Data

Sep. 12, 2014 (DE) ..... 10 2014 218 378

(51) Int. Cl.
*F16F 1/34* (2006.01)
*F01P 7/10* (2006.01)
(Continued)

(52) U.S. Cl.
CPC ..... *F28F 9/22* (2013.01); *F28F 17/005* (2013.01); *F28F 19/002* (2013.01);
(Continued)

(58) Field of Classification Search
CPC .. F28F 17/005; F28F 19/002; F28F 2009/222; F28D 2021/0082
(Continued)

(56) References Cited

U.S. PATENT DOCUMENTS 1,295,629 A * 2/1919 Stewart ..... F01P 7/10 165/98
1,439,074 A * 12/1922 Donaldson ..... F01P 7/10 165/98
(Continued)

FOREIGN PATENT DOCUMENTS

AT 308 332 B 6/1973
DE 32 26 191 A1 2/1983
(Continued)

*Primary Examiner* — Len Tran
*Assistant Examiner* — Paul Alvare
(74) *Attorney, Agent, or Firm* — Muncy, Geissler, Olds & Lowe, P.C.

(57) ABSTRACT

A gas-cooled heat exchanger, in particular a direct intercooler, for cooling of a fluid which flows through the heat exchanger, with a heat transfer block featuring a plurality of flow channels, with a first collection chamber and a second collection chamber. The collection chambers are fluidically connected with one another via the flow channels and the outside of the heat transfer block can be perfused by gas. In the direction of the perfusion, a screen is arranged in front of the heat transfer block for the prevention of flow in certain areas around the flow channels of the screen. One of the collection chambers features a vent for discharge of condensate of the fluid which can be sealed from or released into the surrounding area of the heat exchanger.

12 Claims, 1 Drawing Sheet

(51) Int. Cl.

| | |
|---|---|
| ***F28F 19/00*** | (2006.01) |
| ***F28F 9/22*** | (2006.01) |
| ***F28F 17/00*** | (2006.01) |
| ***F28F 27/00*** | (2006.01) |
| *F28D 21/00* | (2006.01) |

(52) U.S. Cl.
CPC ..... *F28F 19/006* (2013.01); *F28F 27/00* (2013.01); *F28D 2021/0082* (2013.01); *F28F 2009/222* (2013.01); *F28F 2265/22* (2013.01)

(58) Field of Classification Search
USPC ..... 165/98, 99, 134.1
See application file for complete search history.

(56) References Cited

U.S. PATENT DOCUMENTS

| | | | | |
|---|---|---|---|---|
| 1,644,690 | A * | 10/1927 | Pritchard | F01P 7/10 165/98 |
| 4,422,502 | A | 12/1983 | Villeval | |
| 2008/0017357 | A1 | 1/2008 | Zeolla | |
| 2010/0229549 | A1* | 9/2010 | Taylor | F02B 29/0468 60/599 |
| 2012/0055151 | A1 | 3/2012 | Durand et al. | |
| 2013/0252538 | A1 | 9/2013 | Huber et al. | |
| 2014/0041381 | A1* | 2/2014 | Kuske | F02B 37/00 60/602 |
| 2015/0246608 | A1 | 9/2015 | Schmidt et al. | |

FOREIGN PATENT DOCUMENTS

| | | | | |
|---|---|---|---|---|
| DE | 34 05 107 | A1 | 8/1985 | |
| DE | 10 2004 015 505 | A1 | 10/2005 | |
| DE | 10 2005 047 840 | A1 | 6/2006 | |
| DE | 10 2007 062 512 | A1 | 6/2009 | |
| DE | 10 2008 019 241 | A1 | 10/2009 | |
| DE | 10 2012 204 431 | A1 | 9/2013 | |
| FR | 2 605 955 | A1 | 5/1988 | |
| FR | 2 922 962 | A1 | 5/2009 | |
| GB | 2 113 819 | A | 8/1983 | |
| JP | 2005-226476 | A | 8/2005 | |
| JP | 2013160117 | A * | 8/2013 | F02B 29/0456 |
| KR | 10-2010-0035741 | A | 4/2010 | |
| WO | WO 2011/102784 | A1 | 8/2011 | |
| WO | WO 2014/053567 | | 4/2014 | |

* cited by examiner

HEAT EXCHANGER HAVING A HEAT TRANSFER BLOCK WITH A SCREEN ARRANGED THEREON

This nonprovisional application claims priority under 35 U.S.C. § 119(a) to German Patent Application No. 10 2014 218 378.2, which was filed in Germany on Sep. 12, 2014, and which is herein incorporated by reference.

BACKGROUND OF THE INVENTION

Field of the Invention

The invention relates to a gas-cooled heat exchanger, in particular a direct intercooler for cooling of a fluid which can flow through the heat exchanger with a heat transfer block featuring a plurality of flow channels, with a first collection chamber and a second collection chamber, wherein the collection chambers are fluidically connected with one another via the flow channels and gas can flow on the outside through the heat transfer block.

Description of the Background Art

Intercoolers are used in modern motor vehicles for increased performance in combustion engines. The intercoolers serve to cool the air flow which is supplied to the combustion engine by, for example, a turbo charger or a compressor.

Through continuous improvements of the heat transfer and with the enlargement of the front surface of the intercoolers used, the cooling capacity has been continuously increased in the past. Particularly the exit temperature of the air flow has thereby been greatly reduced, while the existing pressure in the intercooler has been continuously raised.

This development led to the possibility of a condensate forming inside the intercooler under certain operating conditions. This particularly occurs under environmental conditions characterized by a high, relative air humidity. With ambient temperatures below the freezing point, the resulting condensate can freeze in the intercooler which can lead to a decrease in performance or to a complete blocking of the intercooler. This can lead to an unwanted stalling of the combustion engine. It can also lead to permanent damage of the intercooler.

In best available technology, there are devices which could counteract the formation and freezing of condensate in intercoolers.

DE 10 2012 204 431 A1, which corresponds to U.S. 2013/0252538, discloses a radiator blind which features adjustable and non-adjustable screens with which the flow area of an air passage opening can be modified. The modification of the flow area serves to change the air-mass flow through the air passage opening. With the help of such a device, air flow around a heat exchanger can be purposefully reduced.

DE 10 2005 047 840 A1, which is incorporated herein by reference, discloses an air-cooled exhaust gas heat exchanger which features a covering device with adjustable screens. The covering device is designed in such a way that by adjusting the screens, air flow around the exhaust gas heat exchanger can be permitted or prevented.

Further, the current state of technology features a device that is formed by a cover which can be positioned above or in front of the heat exchanger in order to reduce the air flow around the heat exchanger.

WO 2011/102784 A1 discloses a device which provides a damper inside the intercooler that restricts perfusion of the heat exchanger.

Further, the current state of technology features devices that provide a permanent opening, e.g. formed by a bore hole at the heat exchanger, which allows for a continuous flow off of the resulting condensate.

FR 2 922 962 discloses a device which provides a collection chamber for the condensate and a draining device via which the collected condensate can be discharged from the heat exchanger.

The disadvantage of the devices according to the conventional art is particularly that the adjustable screen device or the cover in front of the heat exchanger generally also impact the cooling performance of the coolant cooler or of other heat exchangers. Moreover, adjustable screens require an activation mechanism and an appropriate control, which is cost-intensive and creates a laborious manufacturing process.

The disadvantage of a damper installed in the heat exchanger is particularly that it requires a controlling and an activation device which can activate and deactivate the damper. This is also complex and expensive.

Providing a permanent opening for the continuous discharge of condensate is disadvantageous since then the heat exchanger is always open. When the engine is at a standstill, water can enter through the opening into the heat exchanger, particularly into the intercooler, which can damage the combustion engine.

The disadvantage of having a collection chamber and a draining device for the condensate is particularly the structural integration of the components into the existing parts. This can lead to significant additional cost.

SUMMARY OF THE INVENTION

It is therefore an object of the present invention to provide a heat exchanger which improves upon the conventional art and reduces the creation of condensate, discharges condensate possibly arising and if necessary, also prevents freezing of the condensate.

An embodiment of the invention relates to a gas-cooled heat exchanger, particularly a direct intercooler for the cooling of a fluid which can flow through the heat exchanger, with a heat transfer block featuring a plurality of flow channels, with a first collection chamber and with a second collection chamber, wherein the collection chambers are fluidically connected with one another via the flow channels and gas can flow on the outside through the heat transfer block, and wherein in front of the heat transfer block, a screen is arranged in the flow direction to prevent air flow around the flow channels of the screen, one area at a time, and wherein one of the collection chambers has a vent for releasing the condensate of the fluid which can be closed or opened towards the surrounding area of the heat exchanger.

The gas-cooled heat exchanger can thereby be perfused by fluid and is surrounded by a flow of gas. This gas can be, for example, air or another medium. In this way, a heat transfer between the fluid flowing on the inside and the gas flowing on the outside can be achieved through the heat exchanger. The screen can be situated at the side of the heat exchanger towards which the flow is directed so that the air flow surrounding the heat exchanger is diverted and directed around the flow channels of the heat transfer block that are covered by the screen. In this way, the cooling performance in the covered flow channels is reduced, effectively preventing formation of condensate in these flow channels, and local cooling in this area is reduced. This counteracts the freezing and the blocking of the heat exchanger resulting therefrom, since that way at least the flow channels covered by the screen do not freeze. The fluid stream flowing through the flow channels covered by the screen can thus be used to vent the condensate formed in the remaining flow channels from the lower section of the heat exchanger, particularly the collection chamber, or to transport it to a vent located in one of the collection chambers.

The vent can be arranged in the collection chamber located downstream to the heat transfer block in a flow direction of the fluid.

Arranging the vent in the collection chamber that is downstream in the flow direction of the fluid is advantageous since this way, the resulting condensate can be carried to the vent through the perfusion of the flow channels. Particularly the fluid stream can carry the resulting condensate in a direction of the vent through the flow channels covered by the screen.

The vent can be arranged in the collection chamber towards the long side of the collection chamber, spaced at a distance from the outer flow channel of the heat transfer block.

Placing the vent spaced at a distance from the outer flow channel is particularly advantageous since in this way, gravity allows the entire condensate formed in the flow channels to flow through the fluid stream inside the heat exchanger in direction of the vent. In addition, a return flow of the collected condensate into the lowest flow channel can thus be effectively avoided.

The vent can be designed as a check valve, wherein a fluid stream can be released through the vent from the collection chamber to the surrounding area.

This is particularly advantageous in preventing an influx of fluid from outside the heat exchanger into the heat exchanger. An influx of fluids and/or dirt particles could lead to contamination of the fluid stream inside the heat exchanger and to damage of the components downstream from the heat exchanger, such as for example a turbo charger or a combustion engine.

the collection chamber, which features the vent at the long side of the end section, can feature a funnel-shaped inner contour which slopes towards the vent.

A funnel-shaped inner contour is advantageous for improving the flow of the condensate towards the vent. The funnel-shaped inner contour can be designed in such a way that the condensate is collected below the lowest flow channel in order to prevent a return flow into the flow channel.

The vent can be controllable as a function of a pressure difference between pressure in the collection chamber, in which the vent is located, and pressure outside of the collection chamber.

For example, at a pressure difference between approximately 1 bar and 2 bar, the vent frees up the flow channel from the collection chamber to the surrounding area of the collection chamber. The vent can hereby be actively triggered by capturing the pressure difference within the heat exchanger and outside the heat exchanger with appropriate sensors. Alternatively, the vent can be structurally designed in such a way that it automatically opens or closes with a predetermined pressure difference.

The vent can or should remain closed when running in idle mode and at low engine loads in order to prevent noise generation at the vent. When opening at higher engine loads, the exhaust noise of the vent can be masked by the sound of the combustion engine which avoids a negative effect on the occupants.

It is also useful when the gas flow around at least one of the flow channels can be prevented with the placement of the screen.

By preventing the surround-flow, or with the reduction of gas flow around the flow channels, a reduction of the cooling performance in these flow channels can be achieved. This leads to a reduced tendency of condensate forming in the at least partially covered flow channels. The respective flow channels lowest in mounting position can be covered by the screen. Depending on the size of the heat exchanger and in accordance with the necessary cooling performance, a varying number of flow channels can be covered. By covering a greater number of flow channels, the cooling performance of the heat exchanger is reduced overall, while the number of flow channels in which no condensate forms is increased. The tendency towards complete freezing or blocking is hereby reduced. A lesser number of covered flow channels leads to less strongly reduced cooling performance while the danger of freezing or blocking of the heat exchanger increases. In this case, preferably an optimum should be found for each individual application.

The screen can cover at least the outer flow channel, or the outer channel and the flow channel directly adjacent to it.

The flow channels that are situated at the lower end section of the heat transfer block can be covered. The condensate that forms in the uncovered, upper flow channels can flow downwards into the collection chambers. The respective, lower flow channels which are covered by the screen are not cooled too strongly due to less surrounding gas flow. The formation of condensate in this area is thus in any case less than in the upper flow channels. As a result, the tendency of these flow channels to be blocked due to freezing is much lower than in the upper, not covered flow channels. Thus, the fluid continues to flow through the lower, covered flow channels, wherein the condensate flowing down from above is carried off to the vent in the collection chamber which is downstream from the heat transfer block. A discharge of the condensate is thus always guaranteed.

The screen can reduce the maximum obtainable cooling performance of the heat exchanger, wherein the screen can reduce the cooling performance to a value between 40% and 95% of the cooling performance which can be obtained under unchanged boundary conditions without the screen.

A reduction of the cooling performance in this area is particularly advantageous since a sufficient cooling performance for the intended use of the heat exchanger can be obtained, while at the same time the tendency towards freezing or blocking of the heat exchanger is sufficiently reduced. In this way, a heat exchanger can be advantageously created which features a sufficient functional reliability even at low outside temperatures.

The screen can be fused with the heat exchanger and/or clipped and/or bonded and/or screwed together and/or clamped.

Depending on the design of the screen and using different methods, the screen can be connected with the heat exchanger or the heat transfer block. The screen can be formed from a metallic or synthetic material.

The pressure of the fluid can lie above the ambient pressure of the heat exchanger. The fluid thereby can have a higher pressure level than the gas which flows around the heat exchanger. This is particularly advantageous for a heat exchanger that is being used as an intercooler since in these, high pressure created by the existing turbo charger or compressor regularly exists.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
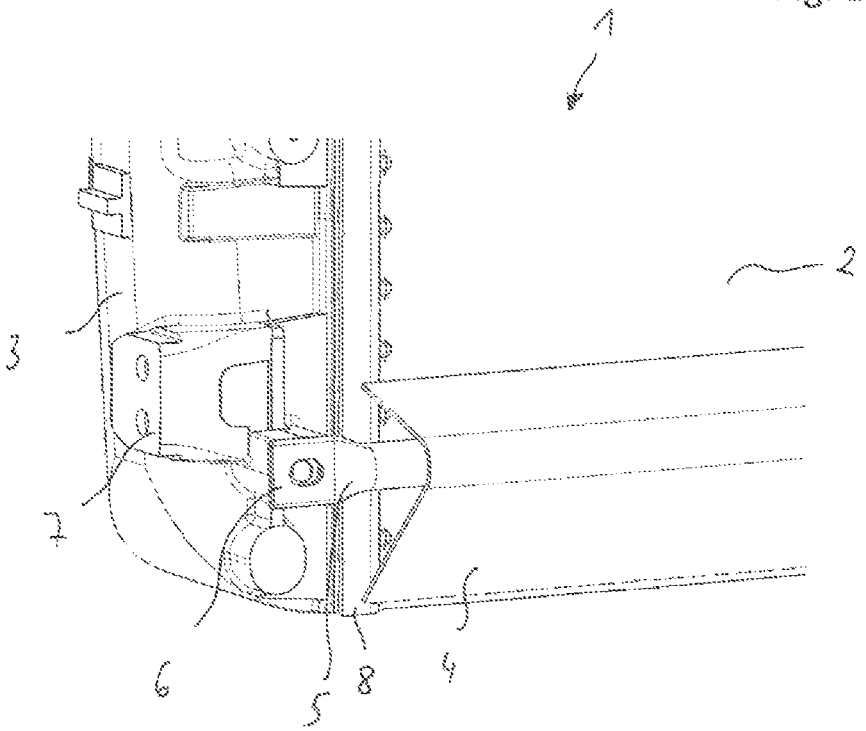
FIG. 1 is a perspective, partial view of a heat exchanger, wherein the lower section of the heat transfer block is covered by a screen.

FIG. 1 shows a perspective, partial view of a heat exchanger 1. The heat exchanger 1 features a heat transfer block 2 which is formed by a plurality of tubes that are not shown and are arranged parallel to one another, and by corrugated fin elements arranged between them. The ends of the tubes of the heat transfer block 2 are each incorporated into a collection chamber 3. In FIG. 1, only one of these collection chambers is shown. In their interior, the tubes form the flow channels 9 of the heat transfer block 2.

The collection chamber 3 features a retaining element 7 with which the collection chamber 3 can be fastened inside a vehicle to surrounding structural elements. The collection chamber 3 further features a mounting device 6 to which a retaining element 5 formed by a rod can be affixed. The retaining element 5 serves to fasten the screen 4 which at least partially covers the heat transfer block 2.

The screen 4 is hereby designed in such a way that a certain number of tubes of the heat transfer block 2 are covered throughout the entire width of the heat exchanger 1. The screen 4 hereby specifically extends from the shown collection chamber 3 to the collection chamber not shown which is located at the opposite end section of the heat transfer block 2.

The screen 4 serves to shield the heat transfer block 2 from air flow which surrounds the heat exchanger. For this purpose, the screen 4 is preferably arranged on the side of the heat exchanger 1 that is fed by gas flowing around the heat exchanger 1. In this way, the gas flowing towards the heat exchanger 1 is diverted upwards and downwards, wherein particularly the tubes arranged above the screen 4 and the area below the heat exchanger 1 are surrounded by the flowing gas.

According to the invention, a fluid flows through the heat exchanger 1. At the heat transfer block 2, a heat transfer occurs between the fluid flowing through the heat exchanger 1 and the gas flowing through the heat exchanger 1. This particularly serves to cool the fluid flowing through the heat exchanger 1.

In the area of the heat transfer block 2 covered by the screen 4, a lesser cooling of the fluid flowing in the covered tubes of the heat transfer block 2 takes place. This way, the tendency towards formation of condensate inside the covered tubes is greatly reduced. Particularly in contrast to the tubes arranged above the screen 4, which are completely surrounded by the flowing gas, the formation of condensate under certain operating conditions in the heat exchanger 1 is much greater than in the tubes covered by the screen 4.

The fluid flowing in the heat exchanger 1 is distributed to the tubes of the heat transfer block 2 in one of the collection chambers 3 and is collected from these tubes in the respective, other collection chambers and is discharged from the heat exchanger 1.

Preferably, the heat exchanger 1 is an intercooler which is used to cool air flow, which is in turn fed to the combustion engine via a turbo charger or a compressor.

In the embodiment in FIG. 1, the screen 4 is triangular and rests with its vertex on the rod of the retaining device 5. This results in sloped surfaces of the screen 4 above the retaining device 5 and below the retaining device 5 which promote the discharge of the air stream flowing upwards or downwards to the screen 4. In the embodiment in FIG. 1, the screen 4 features an angled contour as a cross-section.

In alternative embodiments, the screen 4 can also be formed as a level, plate-shaped component arranged in front of a certain number of tubes. The screen can also be combined with the heat exchanger in one piece or connected to the heat exchanger via methods such as welding, bonding, clamping or clipping. The screen 4 is preferably formed from a metallic material so that it can be easily connected to the heat transfer block.

In a further, preferred embodiment, the screen can be formed from synthetic material which particularly simplifies its production and the screen can be designed in an especially cost-effective manner. The screen can preferably be produced in an extrusion process which allows for simple manufacturing within the framework of a mass production.

In a further, preferred embodiment, the screen can also contain a number of openings which allow at least a partial surround-flow of the covered tubes of the heat transfer block. It is also possible that the screen only extends over a portion of the heat transfer block. A screen partitioned into several, individual parts can also be provided so that for example only the tube end sections facing the collection chambers are covered.

The basic objective of the screen 4 is to reduce the air flow directed at the covered tubes by a certain amount in order to reduce the cooling performance in the covered tubes. Hereby, the cooling performance should preferably be reduced by 40% and 95% as compared to the uncovered tubes.

The reduction of cooling performance in the covered tubes particularly prevents the formation of condensate. This ensures that at no point in time, freezing and the resulting blocking of the covered tubes of the heat transfer block 2 occurs. This allows for an air flow to be transported at any time through at least the heat exchanger 1 through the tubes covered by the screen 4.

Figure 2:
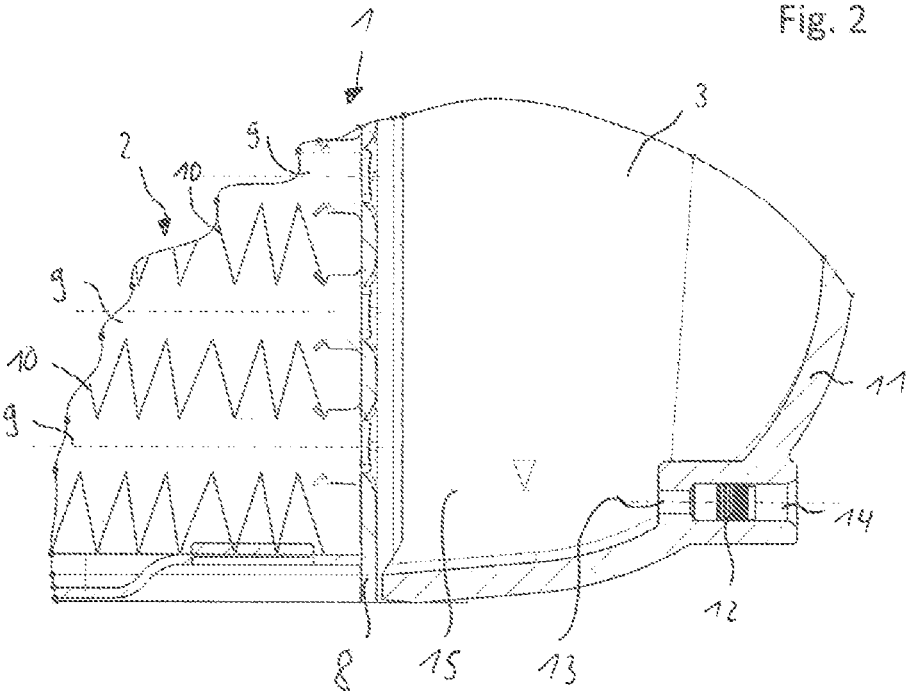
FIG. 2 is a sectional view of the heat exchanger, wherein a section of the heat transfer block and a section of the collection chamber are shown, wherein the collection chamber displays a vent at the lower end section.

FIG. 2 shows a cross-section of the heat exchanger 1. The cross-section illustrates that the tubes which each form a flow channel 9 are arranged parallel on top of one another inside the heat transfer block 2. Corrugated fin elements 10 are arranged between the individual flow channels 9 which are meant to improve particularly the heat transfer between the gas flowing around the heat transfer block 2 and the fluid flowing through the flow channels 9. The ends of the flow channels 9 are each incorporated into the tube sheet 8 to which a cover-shaped wall 11 is connected which forms the collection chamber 3 between the tube sheet 8 and the wall 11. The flow channels 9 thus all unilaterally flow to the inner volume of the illustrated collection chamber 3. FIG. 2 shows collection chamber 3 on the outlet side.

In the wall 11 of collection chamber 3, a vent 12 is arranged which features a vent inlet side 13 and a vent outlet side 14. The vent inlet side 13 points towards the inner volume of the collection chamber 13 whereas the vent outlet side 14 is directed towards the surrounding area. The vent 12 is formed in such a way that a fluid stream can only flow from inside the collection chamber 3 out into the surrounding area. The vent 12 particularly serves to discharge condensate which can form within the heat exchanger 1. For this purpose, the vent 12 is pressure controlled and can be opened or closed by a pressure difference formed inside the heat exchanger 1 and outside the heat exchanger 1. Preferably, the vent 12 is designed in such a way that it only opens when the combustion engine is operated with a predefined, minimum load.

FIG. 2 shows that the top edge of the vent inlet side 13 is arranged below a contour line 15 which is also arranged below the bottom edge of the lowest flow channel 9. This ensures that the inlet to the vent 12 lies below the lowest point of the lowest flow channel 9 at all times. This serves to better discharge the resulting condensate from the collection chamber 3. If the vent 12 is situated higher, the condensate could flow back into the lower flow channel 9 which could again result in a freezing or blocking of the lower flow channel 9.

In an alternative embodiment, the collection chamber can feature a funnel-shaped inner contour in the region of the lower end section which can particularly enable an influx of the condensate collected in the collection chamber towards the vent. This would allow for further improved removal of the condensate from the collection chamber.

The embodiments shown in FIGS. 1 and 2 are examples and their purpose is to illustrate the concept of the invention. Particularly in respect of the detailed design of the heat exchanger 1 or the design of the collection chambers 3, FIGS. 1 and 2 have no restrictions. The arrangement or design of the screen 4 in FIG. 1 is also exemplary. In alternative embodiments, other screens can also be used. The main purpose of screen 4 is the at least partial covering of a predefined number of tubes of the heat transfer block 2 at the lower end section of the heat transfer block 2.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A gas-cooled heat exchanger for cooling of a fluid flowing through the heat exchanger, the heat exchanger comprising:

a heat transfer block having a plurality of flow channels, an outside of the heat transfer block being perfused by a gas;

a first collection chamber;

a second collection chamber positioned downstream of the first collection chamber, the first and second collection chambers being fluidly connected with one another via the flow channels, a screen being arranged on the heat transfer block in a direction of the perfusion in front of the heat transfer block for prevention of flow of the gas around at least one of the flow channels;

a vent being arranged in the second collection chamber for discharge of condensate of the fluid into the surrounding area of the heat exchanger, a first mounting device provided on the first collection chamber and a second mounting device provided on the second collection chamber, and a retaining rod having a first end fixed to the first mounting device and a second end fixed to the second mounting device, wherein the screen is angled along a length thereof, such that the screen has a vertex, a first sloped surface and a second sloped surface, the first sloped surface and the second sloped surface extending from opposing sides of the vertex in a direction towards the heat transfer block, and wherein the distal ends of the first sloped surface and the second sloped surface are positioned closer to the heat transfer block than the vertex, and wherein an inner surface of the vertex of the screen is positioned on the retaining rod.

2. The heat exchanger according to claim 1, wherein the second collection chamber is situated downstream from the heat transfer block in a flow direction of the fluid.

3. The heat exchanger according to claim 1, wherein the vent is arranged at a lower end of the second collection chamber and is spaced at a distance from a lowest positioned flow channel of the heat transfer block.

4. The heat exchanger according to claim 1, wherein the vent is a check valve, wherein a fluid stream is releasable from the second collection chamber into the surrounding area through the vent.

5. The heat exchanger according to claim 1, wherein the second collection chamber has a funnel-shaped inner contour that forms a slope in a direction towards the vent.

6. The heat exchanger according to claim 1, wherein the vent is controllable as a function of a pressure difference between pressure in the second collection chamber in which the vent is located and pressure outside of the second collection chamber, wherein a pressure sensor is provided to sense the pressure in the second collection chamber and a pressure sensor is provided to sense the pressure outside of the second collection chamber.

7. The heat exchanger according to claim 1, wherein the screen covers at least a lowest positioned flow channel of the heat transfer block or the lowest positioned flow channel and a flow channel positioned directly above the lowest positioned flow channel.

8. The heat exchanger according to claim 1, wherein the screen reduces a cooling performance of the heat exchanger by between 40% and 95%.

9. The heat exchanger according to claim 1, wherein the screen is fused or clipped or bonded or screwed together or clamped with the heat exchanger.

10. The heat exchanger according to claim 1, wherein the gas-cooled heat exchanger is a direct intercooler.

11. The heat exchanger according to claim 1, wherein the first sloped surface is sloped towards the heat transfer block in an upward direction and the second sloped surface is sloped towards the heat transfer block in a downward direction.

12. The heat exchanger according to claim 6, wherein the vent is a check valve.

* * * * *